US006431158B1

(12) United States Patent
Gagnon et al.

(10) Patent No.: US 6,431,158 B1
(45) Date of Patent: Aug. 13, 2002

(54) EXHAUST GAS FLOW MEASURMENT DEVICE

(75) Inventors: Frederic Gagnon; Peter Hueniken; Kenneth Peter Nydam, all of Chatham (CA)

(73) Assignee: Siemens Canada Limited, Mississauga (CA)

( * ) Notice: Subject to any disclaimer, the term of this patent is extended or adjusted under 35 U.S.C. 154(b) by 0 days.

(21) Appl. No.: 09/722,763

(22) Filed: Nov. 27, 2000

Related U.S. Application Data

(60) Provisional application No. 60/167,966, filed on Nov. 30, 1999.

(51) Int. Cl.[7] ..... F02M 25/07

(52) U.S. Cl. ..... 123/568.27; 123/568.16

(58) Field of Search ..... 123/568.11, 568.16, 123/568.26, 568.27, 568.28, 568.29

(56) References Cited

U.S. PATENT DOCUMENTS

| | | | | |
|---|---|---|---|---|
| 3,981,283 A | | 9/1976 | Kaufman | |
| 4,022,237 A | | 5/1977 | Wertheimer | |
| 4,186,699 A | | 2/1980 | Aoyama | |
| 4,196,707 A | * | 4/1980 | Stoltman | 123/568.27 |
| 4,566,423 A | | 1/1986 | Kenny et al. | |
| 4,690,120 A | * | 9/1987 | Egle | 123/568.16 |
| 5,279,273 A | * | 1/1994 | Nakata et al. | 123/568.27 |
| 5,341,300 A | * | 8/1994 | Fujimoto | 123/568.16 |
| 5,613,479 A | | 3/1997 | Gates et al. | 123/568.16 |
| 5,632,257 A | * | 5/1997 | Machida et al. | 123/568.16 |
| 6,014,961 A | * | 1/2000 | Gates | 123/568.27 |
| 6,116,224 A | | 9/2000 | Cook et al. | 123/568.27 |

FOREIGN PATENT DOCUMENTS

WO WO 01/12972 A1 2/2001

OTHER PUBLICATIONS

US 6,092,513, 07/2000, Kotwicki et al. (withdrawn)*

* cited by examiner

*Primary Examiner*—Willis R. Wolfe

(57) ABSTRACT

An internal combustion engine exhaust emission control system has a module for conveying exhaust gas from an engine exhaust system to an engine intake system. A valve selectively restricts the flow path. A pressure sensing passage communicates a pressure sensing port of a pressure sensor to the flow path. The pressure sensing passage comprises a tube having an end portion passing through a through-hole in a side wall of the flow path. In one embodiment, an open free end of the tube is disposed within the flow path in spaced relation to the side wall opposite an orifice that creates a pressure drop for obtaining a flow measurement using pressure sensed via the tube as one input. In another embodiment, the open free end of the tube is disposed flush with the side wall opposite a nozzle.

16 Claims, 4 Drawing Sheets

EXHAUST GAS FLOW MEASURMENT DEVICE

REFERENCE TO RELATED APPLICATION AND PRIORITY CLAIM

This application expressly claims the benefit of earlier filing date and right of priority from the following patent application: U.S. Provisional Application Ser. No. 60/167,966, filed on Nov. 30,1999 in the names of Frederic Gagnon, Peter Hueniken, and Kenneth Peter Nydam and entitled "EGR Flow Measurement Device And Method". The entirety of that earlier-filed, co-pending patent application is hereby expressly incorporated herein by reference.

FIELD OF THE INVENTION

This invention relates generally to automotive emission control valves and systems, such as exhaust gas recirculation (EGR) valves that are used in exhaust emission control systems of automotive vehicle internal combustion engines. More specifically, the invention relates to an improvement for measuring the gas flow in an emission control valve and/or system.

BACKGROUND OF THE INVENTION

Commonly owned U.S. Pat. No. 6,116,224 (Cook and Busato) discloses an EGR system comprising an EGR module. One element of that module is a pressure sensor that senses pressure differential across a circular orifice through which exhaust gas flow is constrained to pass when a valve of the module allows flow to the engine intake system.

A circular orifice of given diameter possesses a known relationship between flow through the orifice and pressure drop across the orifice. In other words, flow through the orifice, and hence flow through the module, can be calculated by measurement of pressure drop across the orifice and applying the known flow/pressure drop relationship to the pressure drop measurement. U.S. Pat. No. 6,116,224 shows various embodiments for communicating the pressure drop across the orifice to the pressure sensor.

Actual measurements of flow through such modules at different pressure drops across their orifices have shown a certain amount of scatter relative to a relationship that should theoretically exist for an ideal orifice. It is believed that greater precision in flow control can be obtained if the amount of scatter can be reduced, and it is toward that objective that the present invention is directed.

SUMMARY OF THE INVENTION

The invention arises out of several discoveries. A first discovery is that scatter can be reduced by how the sensing port of a pressure sensor is communicated to the gas flow passage that extends through a module. A second discovery is that scatter can be reduced by using a nozzle instead of an orifice. A third discovery results from combining the first two discoveries.

One generic aspect of the invention relates to an internal combustion engine exhaust emission control system comprising a flow path for conveying exhaust gas from an exhaust system of the engine to an intake system of the engine. A valve selectively restricts the flow path. A pressure sensor having a pressure sensing port is communicated via a pressure sensing passage to the flow path. A side wall bounds a portion of the flow path, and the pressure sensing passage comprises a tube having an end portion passing through a through-hole in the side wall of the flow path to dispose an open free end of the tube within the flow path in spaced relation to the side wall.

A further generic aspect relates an internal combustion engine exhaust emission control system comprising a flow path for conveying exhaust gas from an exhaust system of the engine to an intake system of the engine. A valve selectively restricts the flow path. A pressure sensor having a pressure sensing port is communicated via a pressure sensing passage to the flow path. A side wall bounds a portion of the flow path, and the pressure sensing passage comprises a tube having an end portion passing through a through-hole in the side wall of the flow path to communicate an open free end of the tube to the flow path in spaced relation to the side wall. A nozzle is disposed in the flow path opposite the open free end of the tube.

BRIEF DESCRIPTION OF THE DRAWINGS

The accompanying drawings, which are incorporated herein and constitute part of this specification, include IS one or more presently preferred embodiments of the invention, and together with a general description given above and a detailed description given below, serve to disclose principles of the invention in accordance with a best mode contemplated for carrying out the invention.

DESCRIPTION OF THE PREFERRED EMBODIMENT

Figure 1:
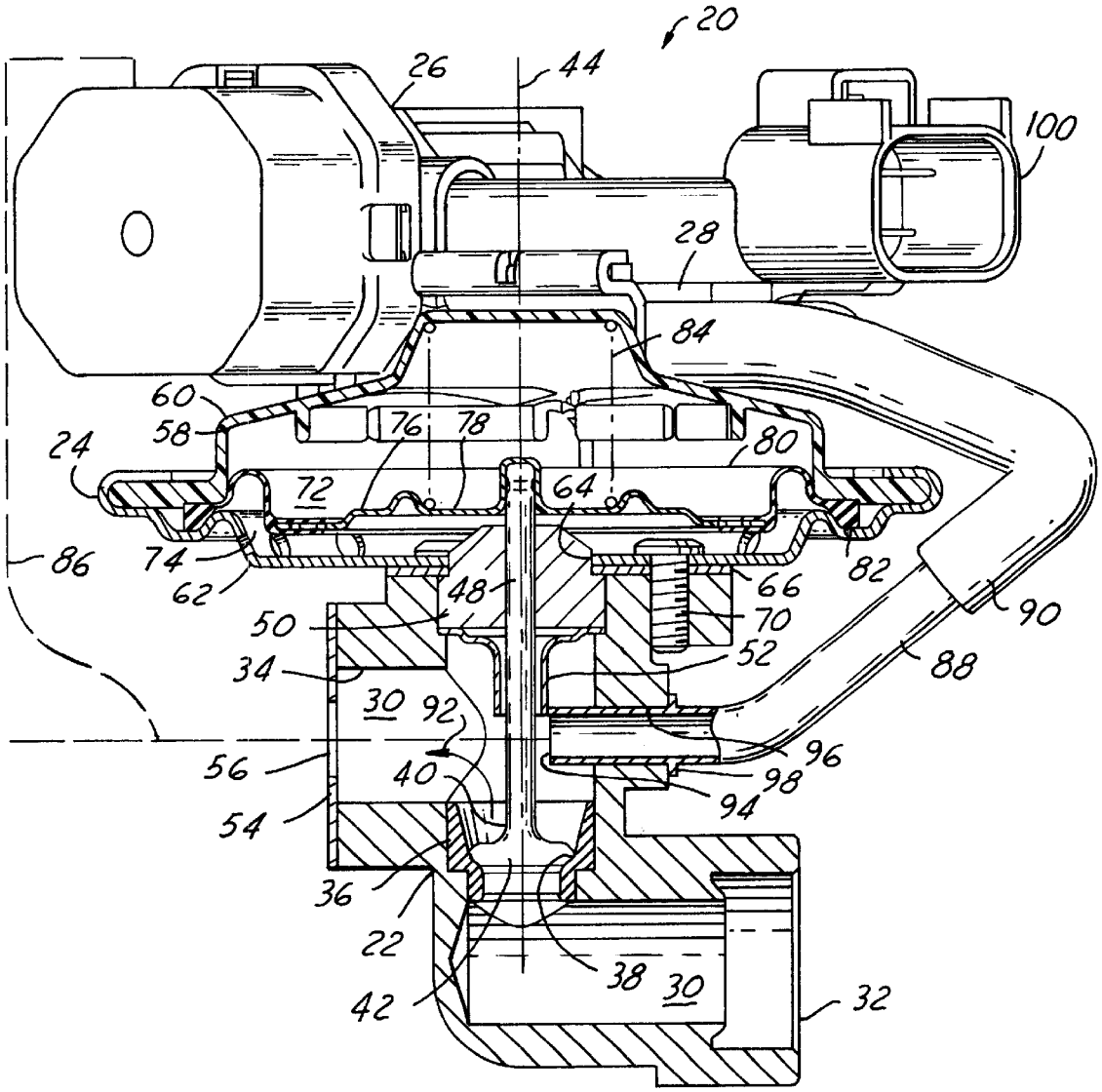
FIG. 1 is a front elevation view, partly in cross section, of a first embodiment of an exemplary module embodying principles of the present invention.

FIG. 1 discloses a module 20 embodying principles of the invention and comprising an emission control valve body 22, a fluid-pressure-operated actuator 24, an electric-operated pressure regulator valve 26, and a sensor 28. Valve 26 is an electric-operated vacuum regulator valve, sometimes referred to as an EVR valve, and sensor 28 is a pressure sensor that provides an electric signal related to the magnitude of sensed vacuum.

Valve body 22 comprises an internal main flow passage 30 extending between a first port 32 and a second port 34. An annular valve seat element 36 is disposed in valve body 22 to provide an annular seat surface 38 circumscribing a transverse cross-sectional area of passage 30. A valve member 40 comprising a non-flow-through valve head 42 is disposed within body 22 coaxial with an imaginary axis 44. Valve head 42 is shown seated on seat surface 38 closing passage 30 to flow between ports 32 and 34.

A stem 48 extends from valve head 42 to operatively connect head 42 with actuator 24 for operating valve member 40 via the actuator. Stem 48 passes with a close sliding fit through a bushing 50 that is fit to body 22 and guides valve member 40 for straight line motion along axis 44. Bushing 50 also captures the outer margin of a circular flange of a generally cylindrical walled metal shield 52 on an internal shoulder of valve body 22. Shield 52 surrounds a portion of stem 48 to direct exhaust gas heat away from the stem when exhaust gas flows through valve body 22. A thin orifice member 54 comprising a circular orifice 56 is disposed at port 34 such that flow through main flow passage 30 is constrained to pass through orifice 56.

Fluid-pressure-operated actuator 24 comprises a body 58 that is in assembly with valve body 22 coaxial with axis 44. Actuator body 58 comprises a first body part 60 and a second body part 62. Body part 62 comprises sheet metal formed to a generally circular shape having a central -hrough-hole 64 that allows the part to fit over a protruding end of bushing 50. An annular gasket 66 is sandwiched between actuator body part 62 and valve body 22. Actuator body part 62, gasket 66, and valve body 22 each contains a like hole pattern that provides for the secure attachment of part 62 to valve body 22 by headed screws 70 whose threaded shanks are passed through aligned holes in part 62 and gasket 66 and tightened into threaded holes in body 22.

Actuator body 58 comprises an interior that is divided into two chamber spaces 72, 74 by a movable actuator wall 76. Movable actuator wall 76 comprises an inner formed metal part 78 and an outer flexible part 80. Part 80 has a circular annular shape including a convolution that rolls as wall 76 moves. Part 80 also has a bead 82 which extends continuously around its outer margin and is held compressed between parts 60 and 62 by an outer margin of body part 62 being folded around and crimped against the outer margin of part 60, thereby securing parts 60, 62, and 76 in assembly and sealing the outer perimeters of chamber spaces 72 and 74. The inner margin of part 80 is insert-molded onto the outer margin of part 78 to create a fluid-tight joint uniting the two parts. Several through-holes in part 62 communicate chamber space 74 to atmosphere. A helical coil compression spring 84 is disposed within chamber space 72 to resiliently bias movable wall 76 axially toward valve seat surface 38, thereby urging valve head 42 toward seating on seat surface 38, and thereby closing passage 30 to flow between ports 32 and 34.

EVR valve 26 comprises a body having an atmospheric inlet port for communication to atmosphere, a source vacuum inlet port for communication to engine intake system vacuum, and a regulated vacuum outlet port. It contains an internal regulating mechanism like that of the EVR valves described in U.S. Pat. Nos. 5,448,981, and 6,116,224.

The internal mechanism of EVR valve 26 further comprises a solenoid that is operated by pulse width modulation. The pulse width modulation of the solenoid modulates the bleeding of vacuum to atmosphere to cause the vacuum in an internal chamber space to be regulated in accordance with the degree of signal modulation within a range that extends essentially from full intake system vacuum applied at the vacuum inlet port to essentially atmospheric pressure applied at the atmospheric inlet port. The regulated vacuum outlet port is directly in communication with that internal chamber space. An internal passage extends from that the regulated vacuum outlet port to actuator chamber space 72 to place the latter in fluid communication with the regulated vacuum in EVR valve 26. Because the regulated vacuum is established by modulation of the solenoid and is communicated to chamber space 72, the extent to which wall 76, and hence valve member 40, is moved along axis 44 against the resistance of spring 84 is controlled by the electric signal applied to the EVR solenoid. In this way, EGR flow to the engine intake system is closely controlled.

Intake system vacuum is communicated to a first pressure sensing port of sensor 28 in any suitable way, for example such as through a tube schematically shown at 86. The tube communicates the intake system side of orifice 56 to the first pressure sensing port of sensor 28.

Sensor 28 comprises a second pressure sensing port that is communicated to pressure at the opposite side of orifice 56. The communication is established by a conduit comprising two tubes 88, 90 fitted together end-to-end. The side wall of valve body 22 bounding main flow path 30 comprises a right angle bend marked generally by the arrow 92. That bend is disposed between valve seat surface 38 and orifice member 54. Hence, orifice 56 is disposed downstream of the bend.

Tube 88 is a formed metal tube having an open free end 94 that is opposite the end that is fitted to tube 90. An end portion of tube 88 passes through a through-hole 96 in the wall of valve body 22 to dispose open free end 94 within main flow path 30 in spaced relation to the valve body wall containing through-hole 96. Through-hole 96 is coaxial with orifice 56, and open free end 94 faces and is also coaxial with orifice 56. Although stem 48 is disposed between open free end 94 and orifice 56, pressure in the flow path upstream of the orifice can be accurately transmitted to pressure sensor 28. Tube 88 includes an external shoulder 98 that abuts the exterior of valve body 22 surrounding through-hole 96 so that open free end is accurately positioned at a desired distance from the interior wall surface of main flow path 30 that contains the through-hole.

An electric connector 100 provides for sensor 28 and EVR valve 26 to be connected with an electric control circuit (not shown). Connector 100 contains five electric terminals, three of which are associated with sensor 28 and two of which, with EVR valve 26. When connector 100 is connected with a mating connector (not shown) leading to the electric circuit that operates module 20, two electric terminals carry pulse width modulated current to the EVR solenoid, and three terminals carry electric current signals related to pressures sensed at the two sensing ports of sensor 28.

Figure 5:
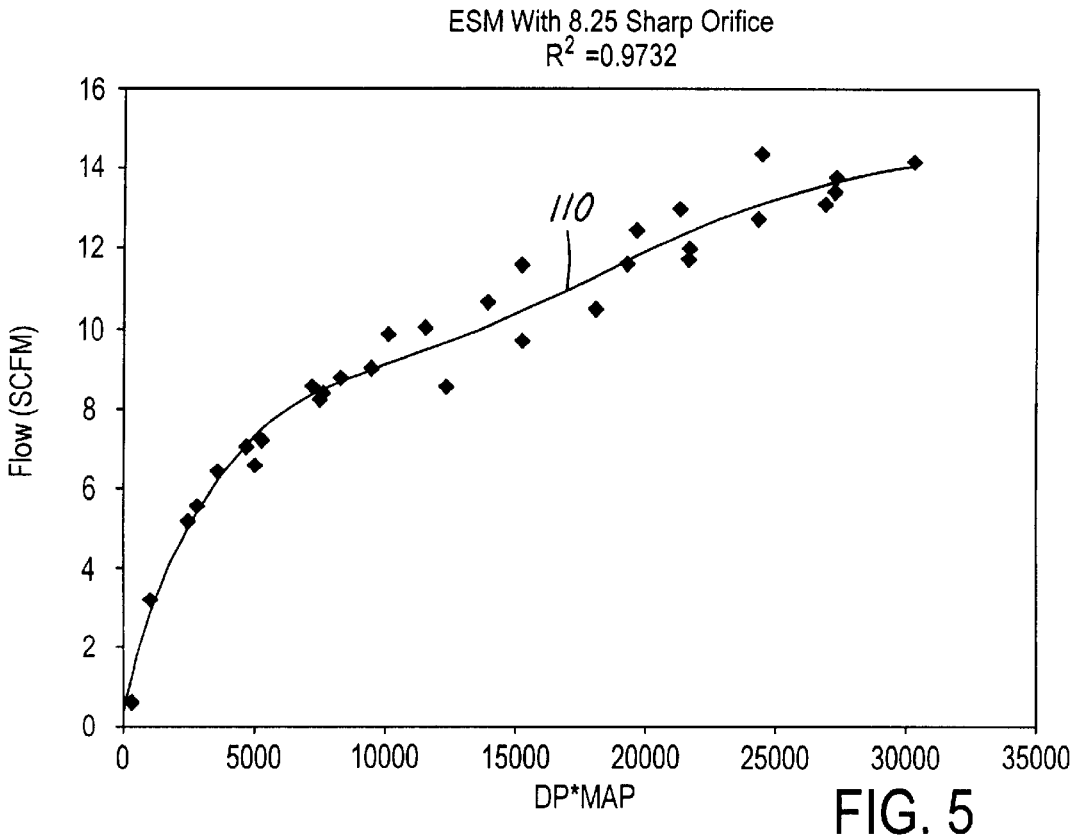
FIG. 5 is a graph plot related to the first embodiment.

FIG. 5 is a desired graph plot 110 of flow rate through orifice 56 versus pressure drop across orifice 56 based on data from testing various modules 20. While some scatter in the data points is present, the scatter is less than in modules where tube 88 does not protrude into main flow passage 30. Hence, it is believed that extending the tube into the passage so that the open free end is spaced from the passage wall represents a meaningful improvement.

Figure 2:
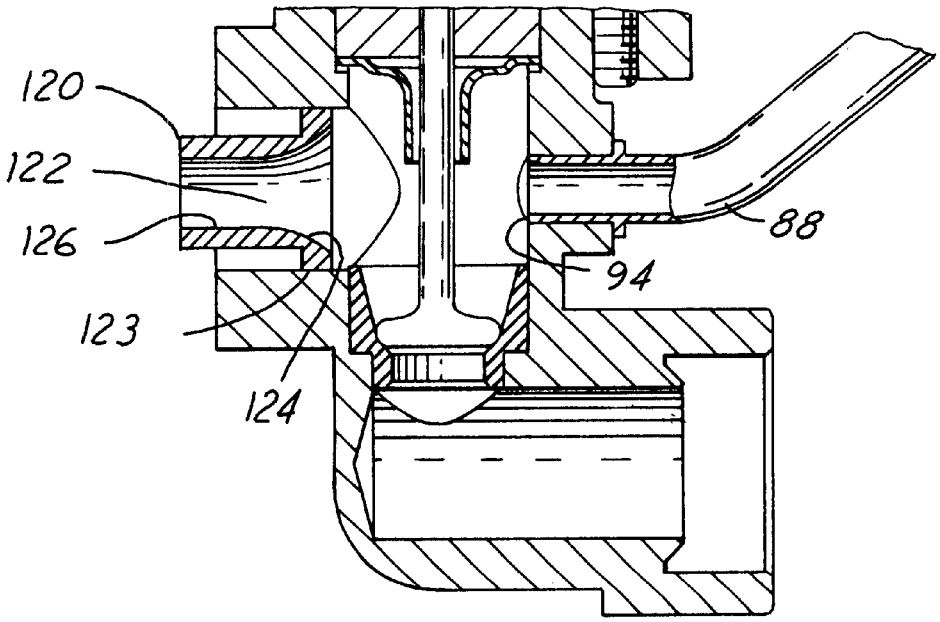
FIG. 2 is a partial front elevation view in cross section of a second embodiment of an exemplary module embodying principles of the present invention.
Figure 4:
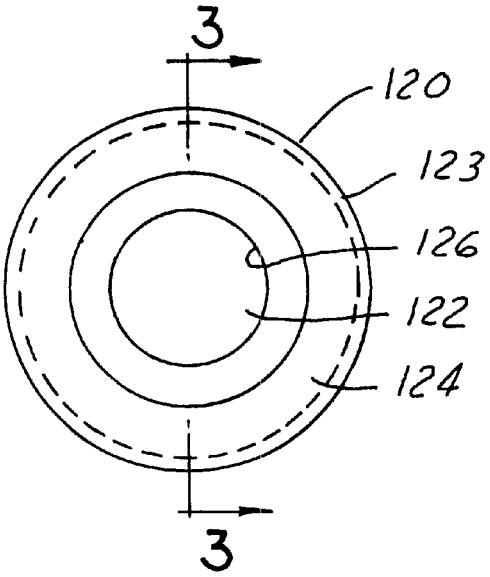
FIG. 4 is full end view in the direction of arrow 4 in FIG. 3.
Figure 3:
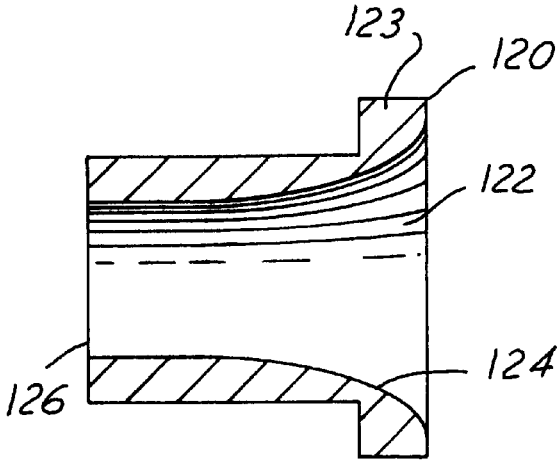
FIG. 3 is an enlarged view of one element of the second embodiment shown by itself.

FIGS. 2, 3, and 4 disclose a second embodiment of module that is like the first except in two respects. Like reference numerals designate like parts in both FIGS. 1 and 2, and so FIG. 2 will be described only to the extent that it differs from FIG. 1.

A nozzle member 120 replaces orifice member 54, and the open free end 94 of tube 88 is substantially flush with the interior wall surface containing through-hole 96.

Nozzle member 120 comprises a flow nozzle 122 that is profiled to contract the flow as the flow passes through it.

Nozzle member 120 is fit concentric with port 34 via a rim 123 to constrain the flow to pass through flow nozzle 122, and flow nozzle 122 is coaxial with open free end 94 of tube 88. The entrance 124 of flow nozzle 122 is profiled to follow the shape of segment of an ellipse, a profile that is preferred, although a non-elliptically contoured profile may be suitable in some modules. The nozzle exit 126 is cylindrical.

Figure 6:
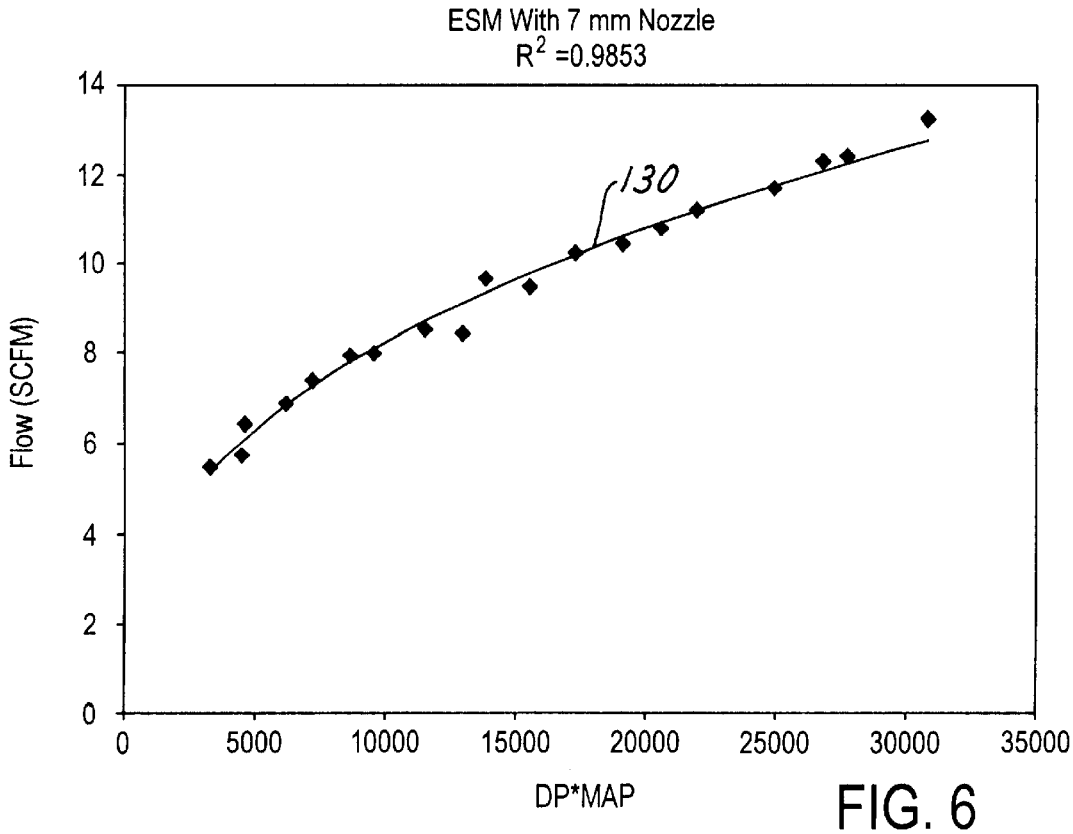
FIG. 6 is a graph plot related to the second embodiment.

FIG. 6 shows a desired graph plot 130 of flow rate through flow nozzle 122 versus pressure drop across flow nozzle 122 based on data from testing various FIG. 2 modules. Very little scatter in the data points is present. Hence, it is believed that the use of a nozzle may provide even more precision in production modules.

Figure 7:
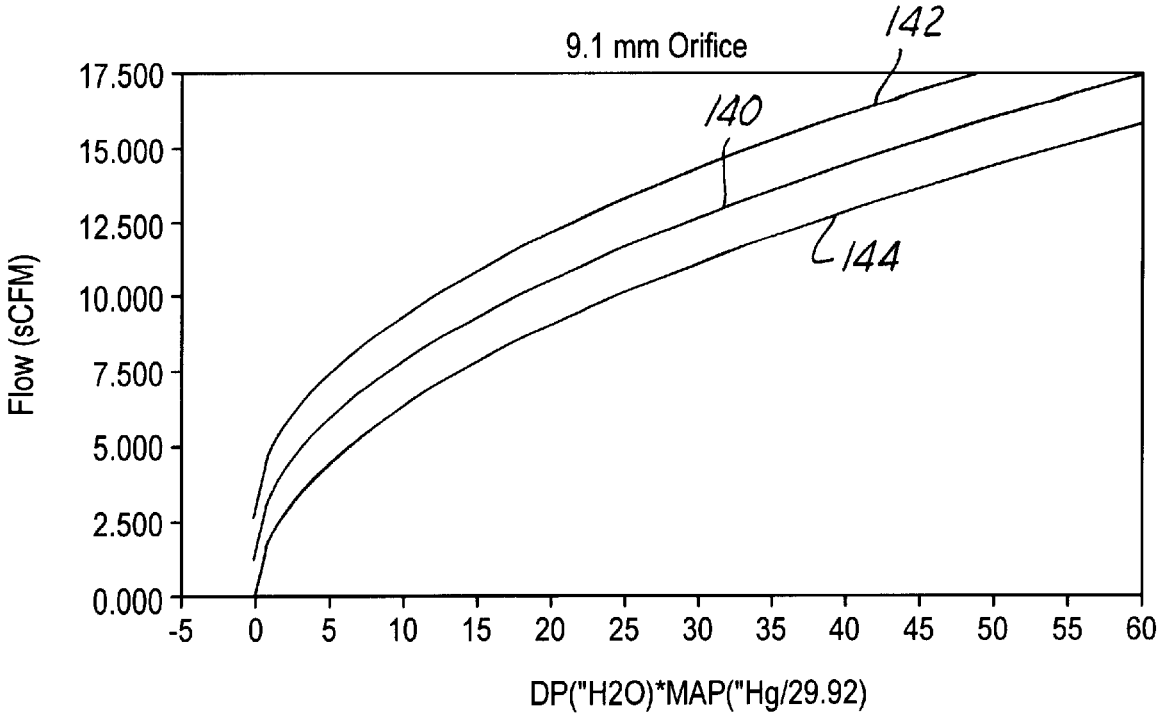
FIG. 7 is a graph plot related to yet another embodiment.

FIG. 7 shows a desired graph plot 140 of flow rate through a valve like the one of FIG. 1, except having a different sized orifice, versus pressure drop across the orifice. The plots 142, 144 represent 1% tolerance limits based on testing a number of valves at several different magnitudes of vacuum. It is believed that this shows that substantial accuracy in the flow characteristic can be obtained in production valves. In all three FIGS. 5, 6, and 7, the horizontal axis is presented as the product of MAP (manifold absolute pressure of the engine) and DP (pressure difference across the orifice or nozzle).

Although not specifically shown in the drawings, another embodiment of module may be like FIG. 2, but with the open free end 94 of tube 88 disposed in the manner of FIG. 1.

It is to be understood that because the invention may be practiced in various forms within the scope of the appended claims, certain specific words and phrases that may be used to describe a particular exemplary embodiment of the invention are not intended to necessarily limit the scope of the invention solely on account of such use.

What is claimed is:

1. An internal combustion engine exhaust emission control system comprising:

a flow path for conveying exhaust gas from an exhaust system of the engine to an intake system of the engine and comprising a side wall bounding a portion of the flow path, a valve for selectively restricting the flow path, a pressure sensor having a pressure sensing port, and a pressure sensing passage communicating the pressure sensing port to the flow path, wherein the pressure sensing passage comprises a tube having an end portion passing through a through-hole in the side wall of the flow path to dispose an open free end of the tube within the flow path in spaced relation to the side wall, and a device which is disposed downstream of the open free end of the tube, through which flow through the flow path is constrained to pass, and which creates a pressure drop in the flow path that bears a known relationship to flow rate through the device for correlating rate of flow through the device to pressure drop across the device, wherein the device comprises a nozzle.

2. An internal combustion engine exhaust emission control system as set forth in claim 1 in which the nozzle constricts the flow passing through it.

3. An internal combustion engine exhaust emission control system comprising:

a flow path for conveying exhaust gas from an exhaust system of the engine to an intake system of the engine and comprising a side wall bounding a portion of the flow path, a valve for selectively restricting the flow path, a pressure sensor having a pressure sensing port, and a pressure sensing passage communicating the pressure sensing port to the flow path, wherein the pressure sensing passage comprises a tube having an end portion passing through a through-hole in the side wall of the flow path to dispose an open free end of the tube within the flow path in spaced relation to the side wall, the side wall bounding a portion of the flow path comprises a valve body having a through-passage extending between an inlet port and an outlet port, a valve seat disposed between the inlet port and the outlet port circumscribing the through-passage, the through-passage comprises a bend between the valve seat and the outlet port, the device is disposed downstream of the bend, and the open free end of the tube faces the device and is coaxial with the device, and the valve comprises a head that coacts with the valve seat to selectively restrict flow through the flow path, and a stem that extends from the valve head to an actuator for positioning the valve head relative to the valve seat and that is disposed between the open free end of the tube and the device.

4. An internal combustion engine exhaust emission control system as set forth in claim 3 in which the device comprises an orifice.

5. An exhaust gas recirculation valve for controlling the recirculation of exhaust gas between an exhaust system and an intake system in an internal combustion engine, the valve comprising:

a valve body having an inlet port for receiving exhaust gas to be recirculated, an outlet port, a flow path through which recirculated exhaust gas is conveyed from the inlet port to the outlet port, a valve for selectively restricting the flow path, a pressure sensor for sensing pressure drop across a device disposed in the flow path, wherein the device comprises a nozzle through which flow through the flow path is constrained to pass, and which creates a pressure drop in the flow path that bears a known relationship to flow rate through the nozzle for correlating rate of flow through the nozzle to pressure drop across the nozzle.

6. An, exhaust gas recirculation valve as set forth in claim 5 in which the nozzle constricts the flow passing through it.

7. An exhaust gas recirculation valve assembly for controlling the recirculation of exhaust gas between an exhaust system and an intake system in an internal combustion engine, the valve assembly comprising:

a valve body having an inlet port for receiving exhaust gas to be recirculated, an outlet port, a flow path through which recirculated exhaust gas is conveyed from the inlet port to the outlet port, a valve for selectively restricting the flow path, the valve comprising a stem disposed in the flow path, a device disposed in the flow path downstream of the valve stem for creating a pressure drop in the flow path that bears a known relationship to flow rate through the device for correlating rate of flow through the device to pressure drop across the device, and a pressure sensor that senses pressure drop across the device and that is communicated with the flow path by a pressure sensing passage that begins at a point in the flow path beyond the valve stem relative to the device and ends at a sensing port of the sensor.

8. An exhaust gas recirculation valve as set forth in claim 7 in which the beginning of the pressure sensing passage comprises a tube having an open free end that faces the device.

9. An exhaust gas recirculation valve as set forth in Claim 8 in which the open free end of the tube and the device are disposed on a common coaxis, and a longitudinal axis of the stem transversely intersects that coaxis between the open free end of the tube and the device.

10. An exhaust gas recirculation valve as set forth in claim 9 in which the device comprises a nozzle.

11. An internal combustion engine exhaust emission control system comprising:

a flow path for conveying exhaust gas from an exhaust system of the engine to an intake system of the engine and comprising a side wall bounding a portion of the flow path, a valve for selectively restricting the flow path, a pressure sensor having a pressure sensing port, and a pressure sensing passage communicating the pressure sensing port to the flow path, a device which is disposed downstream of where the pressure sensing passage communicates to the flow path, through which flow through the flow path is constrained to pass, and which creates a pressure drop in the flow path that bears a known relationship to flow rate through the device for correlating rate of flow through the device to pressure drop across the device, wherein the device comprises a nozzle.

12. An internal combustion engine exhaust emission control system as set forth in claim 11 in which the pressure sensing passage comprises a tube having an end portion passing through a through-hole in the side wall of the flow path to dispose an open free end of the tube substantially flush with the side wall.

13. An internal combustion engine exhaust emission control system as set forth in claim 11 in which the nozzle constricts the flow passing through it.

14. An internal combustion engine exhaust emission control system as set forth in claim 13 in which the side wall bounding a portion of the flow path comprises a valve body having a through-passage extending between an inlet port and an outlet port, a valve seat is disposed between the inlet port and the outlet port circumscribing the through-passage, the through-passage comprises a bend between the valve seat and the outlet port, the device is disposed downstream of the bend, and the open free end of the tube faces the device.

15. An internal combustion engine exhaust emission control system as set forth in claim 14 in which the open free end of the tube is coaxial with the device.

16. An internal combustion engine exhaust emission control system as set forth in claim 15 in which the valve comprises a head that coacts with the valve seat to selectively restrict flow through the flow path, and a stem that extends from the valve head to an actuator for positioning the valve head relative to the valve seat and that is disposed between the open free end of the tube and the device.

* * * * *